US009109835B2

(12) United States Patent
Lin

(10) Patent No.: US 9,109,835 B2
(45) Date of Patent: Aug. 18, 2015

(54) METHOD AND CONTROL SYSTEM FOR CONTROLLING SUPPLY OF HEAT ENERGY FROM A FURNACE TO MULITPLE DRYERS

(75) Inventor: Jung-Lang Lin, Taichung (TW)

(73) Assignee: Suncue Company Ltd, Taichung (TW)

( * ) Notice: Subject to any disclaimer, the term of this patent is extended or adjusted under 35 U.S.C. 154(b) by 827 days.

(21) Appl. No.: 13/301,011

(22) Filed: Nov. 21, 2011

(65) Prior Publication Data

US 2013/0125413 A1 May 23, 2013

(51) Int. Cl.

| | |
|---|---|
| ***F26B 3/00*** | (2006.01) |
| ***F26B 21/12*** | (2006.01) |
| *F26B 23/02* | (2006.01) |

(52) U.S. Cl.

CPC ..... *F26B 21/12* (2013.01); *F26B 23/02* (2013.01); *F26B 2200/06* (2013.01)

(58) Field of Classification Search

CPC ..... F23N 5/102; F23N 1/005; F23N 1/00; F23N 5/143; F23N 2035/04; F24D 19/1084; F26B 21/12; F26B 2200/06; F26B 23/026; F26B 23/02; C10B 49/02; C10B 53/02

USPC ..... 34/491, 495, 524, 551, 565, 487, 497, 34/86, 549, 501, 486; 431/41; 68/5 C; 432/58; 110/245, 224

See application file for complete search history.

(56) References Cited

U.S. PATENT DOCUMENTS

| | | | | |
|---|---|---|---|---|
| 3,482,327 | A * | 12/1969 | Dutcher | 34/386 |
| 7,393,206 | B2 | 7/2008 | Lin | |
| 7,422,429 | B2 | 9/2008 | Lin | |
| 2006/0112588 | A1 * | 6/2006 | Ness et al. | 34/513 |
| 2006/0242858 | A1 * | 11/2006 | Beaulac | 34/446 |

* cited by examiner

*Primary Examiner* — Kenneth Rinehart
*Assistant Examiner* — Bao D Nguyen
(74) *Attorney, Agent, or Firm* — Holland & Hart LLP

(57) ABSTRACT

A method for controlling supply of heat energy from a furnace to multiple dryers includes: determining a preset temperature, a preset humidity and a drying time for each of the dryers; calculating heat energy demand of each of the dryers according to the preset temperature, the preset humidity and the drying time of a respective one of the dryers, and calculating a fuel amount to be supplied to the furnace, and a volume of hot air to be supplied to each of the dryers; detecting a drying temperature in each of the dryers; and for each of the dryers, comparing the drying temperature and the preset temperature of the dryer, increasing the volume of hot air when the drying temperature is lower than the preset temperature, and decreasing the volume of hot air when the drying temperature is higher than the preset temperature.

6 Claims, 3 Drawing Sheets

METHOD AND CONTROL SYSTEM FOR CONTROLLING SUPPLY OF HEAT ENERGY FROM A FURNACE TO MULITPLE DRYERS

BACKGROUND OF THE INVENTION

1. Field of the Invention

The present invention relates to a method and a control system for controlling supply of heat energy, more particularly to a method and a control system for controlling supply of heat energy from a furnace to multiple dryers, and capable of monitoring and controlling drying process of the dryers.

2. Description of the Related Art

In general, a raw material may be burned to generate usable heat energy even if the raw material such as hull and shell waste of agricultural crops is inedible. Heat exchange furnaces disclosed in U.S. Pat. Nos. 7,422,429 and 7,393,206 may generate usable heat energy by means of burning the raw material, so as to achieve effects of resource recycling and energy reuse.

Heat energy generated by the aforementioned heat exchange furnaces is mostly applied to a dryer for drying materials such as grains, flowers and fruits. However, conventionally, the effect of drying materials is achieved through supplying heat energy generated from a single furnace to a single dryer. This not only wastes burnable resources, but arises in higher equipment costs, such that a need for economic efficiency may not be satisfied.

It has been proposed heretofore to supply heat energy from one furnace to multiple dryers in industry. However, since heat energy required by the multiple dryers is generated from the same furnace, a drying condition in each of the dryers is set identically as a result of a limitation in pipe connections. Therefore, it is not easy to use, and a demand for setting different drying conditions in corresponding dryers may not be satisfied.

SUMMARY OF THE INVENTION

Therefore, an object of the present invention is to provide a method and a control system for controlling supply of heat energy from a furnace to multiple dryers. The method and control system are capable of promoting economic efficiency and setting individual drying conditions with respect to the dryers.

In one aspect, the method for controlling supply of heat energy from a furnace to multiple dryers, according to the present invention, is to be implemented by a control system. The method comprises:

(A) configuring the control system to determine a preset temperature, a preset humidity and a drying time for each of the dryers;

(B) configuring the control system to calculate heat energy demand of each of the dryers according to the preset temperature, the preset humidity and the drying time of a respective one of the dryers, and to calculate a fuel amount to be supplied to the furnace according to the heat energy demand of each of the dryers, and a volume of hot air to be supplied to each of the dryers according to the heat energy demand of a respective one of the dryers;

(C) configuring the control system to detect a drying temperature in each of the dryers; and (D) for each of the dryers, configuring the control system to compare the drying temperature and the preset temperature of the dryer, to increase the volume of hot air supplied from the furnace to the dryer when the drying temperature is lower than the preset temperature, and to decrease the volume of hot air supplied from the furnace to the dryer when the drying temperature is higher than the preset temperature.

In another aspect, the control system for controlling supply of heat energy from a furnace to multiple dryers, according to the present invention, comprises a calculating module, a detecting module, and a control module. The calculating module is for calculating heat energy demand of each of the dryers according to a preset temperature, a preset humidity and a drying time of a respective one of the dryers, and is for calculating a fuel amount to be supplied to the furnace according to the heat energy demand of each of the dryers, and a volume of hot air to be supplied to each of the dryers according to the heat energy demand of a respective one of the dryers. The detecting module is for detecting a drying temperature in each of the dryers. The control module is associated operably with the calculating module and the detecting module. For each of the dryers, the control module is configured to compare the drying temperature and the preset temperature of the dryer, to increase the volume of hot air supplied from the furnace to the dryer when the drying temperature is lower than the preset temperature, and to decrease the volume of hot air supplied from the furnace to the dryer when the drying temperature is higher than the preset temperature.

The effect of the present invention resides in satisfying individual drying conditions with respect to the dryers by intelligently using heat energy generated from the same furnace, so as to promote economic efficiency.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
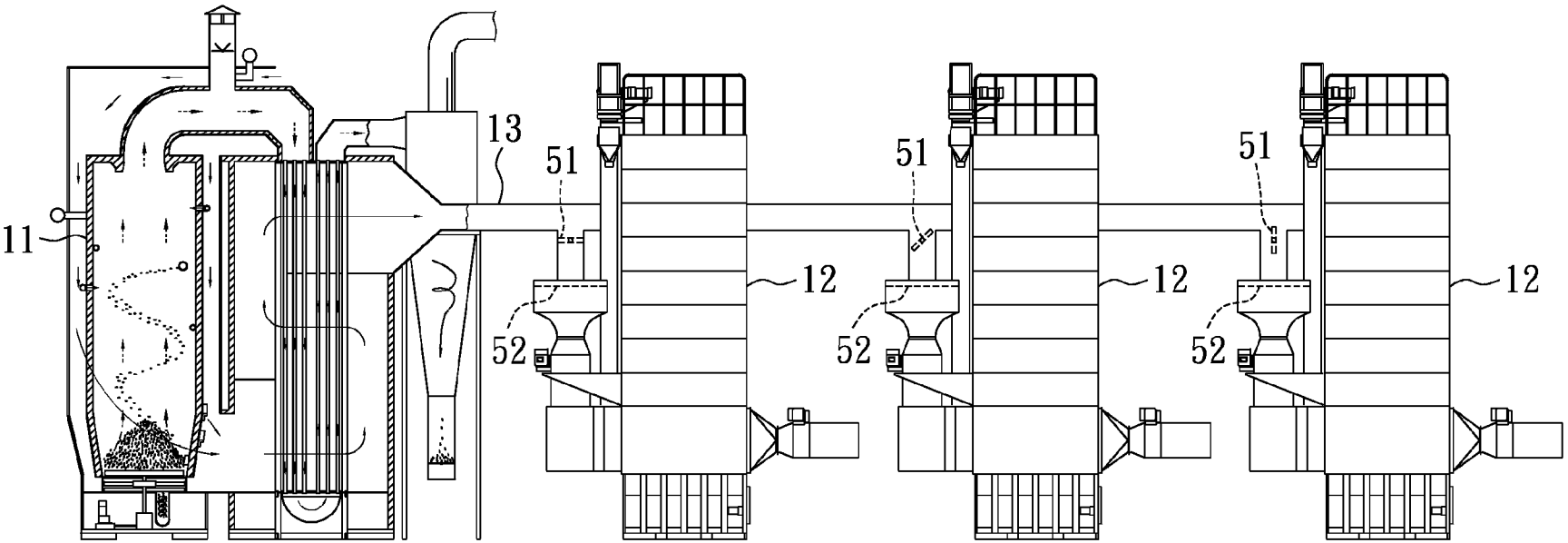
FIG. 1 is a schematic diagram illustrating a preferred embodiment of a method and a control system for controlling supply of heat energy from a furnace to multiple dryers according to the present invention.
Figure 2:
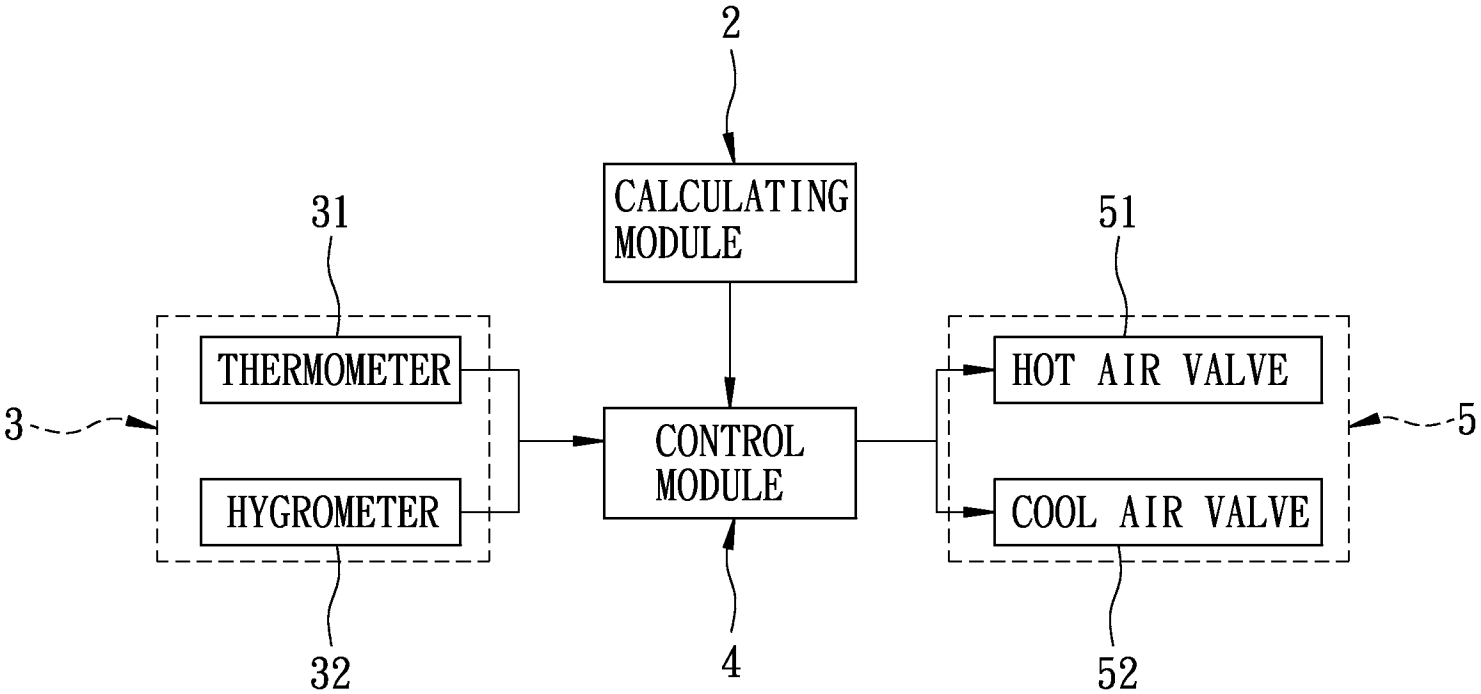
FIG. 2 is a block diagram of the preferred embodiment.

Referring to FIG. 1 and FIG. 2, a preferred embodiment of a control system for controlling supply of heat energy from a furnace 11 to multiple dryers 12, according to the present invention, is illustrated. The furnace 11 is connected to the multiple dryers 12 via a pipe network 13. The control system comprises a calculating module 2, a detecting module 3, a control module 4, and a plurality of valve units 5.

The calculating module 2 is for calculating heat energy demand of each of the dryers 12 according to a preset temperature $T_0$, a preset humidity $W_0$ and a drying time t of a respective one of the dryers 12, and is for calculating a fuel amount to be supplied to the furnace 11 according to the heat energy demand of each of the dryers 12, and a volume of hot air to be supplied to each of the dryers 12 according to the heat energy demand of a respective one of the dryers 12.

The detecting module 3 includes a plurality of thermometers 31 and a plurality of hygrometers 32. Each of the thermometers 31 is disposed in a respective one the dryers 12 for detecting a drying temperature T in the respective one of the dryers 12. Each of the hygrometers 32 is disposed in a respective one of the dryers 12 for detecting a humidity W in the respective one of the dryers 12.

The control module 4 is associated operably with the calculating module 2 and the detecting module 3. For each of the dryers 12, the control module 4 is configured to compare the drying temperature T and the preset temperature $T_0$ of the dryer 12, to increase the volume of hot air supplied from the furnace 11 to the dryer 12 when the drying temperature T is lower than the preset temperature $T_0$, and to decrease the volume of hot air supplied from the furnace 11 to the dryer 12 when the drying temperature T is higher than the preset temperature $T_0$.

Each of the valve units 5 is to be disposed in the pipe network 13 between the furnace 11 and a respective one of the dryers 12. Each of the valve units 5 is controlled by the control module 4, and includes a hot air valve 51 and a cool air valve 52. The hot air valve 51 is operable to adjust the volume of hot air supplied from the furnace 11 to the respective one of the dryers 12. The cool air valve 52 is operable to control mixing of cool air with hot air.

Figure 3:
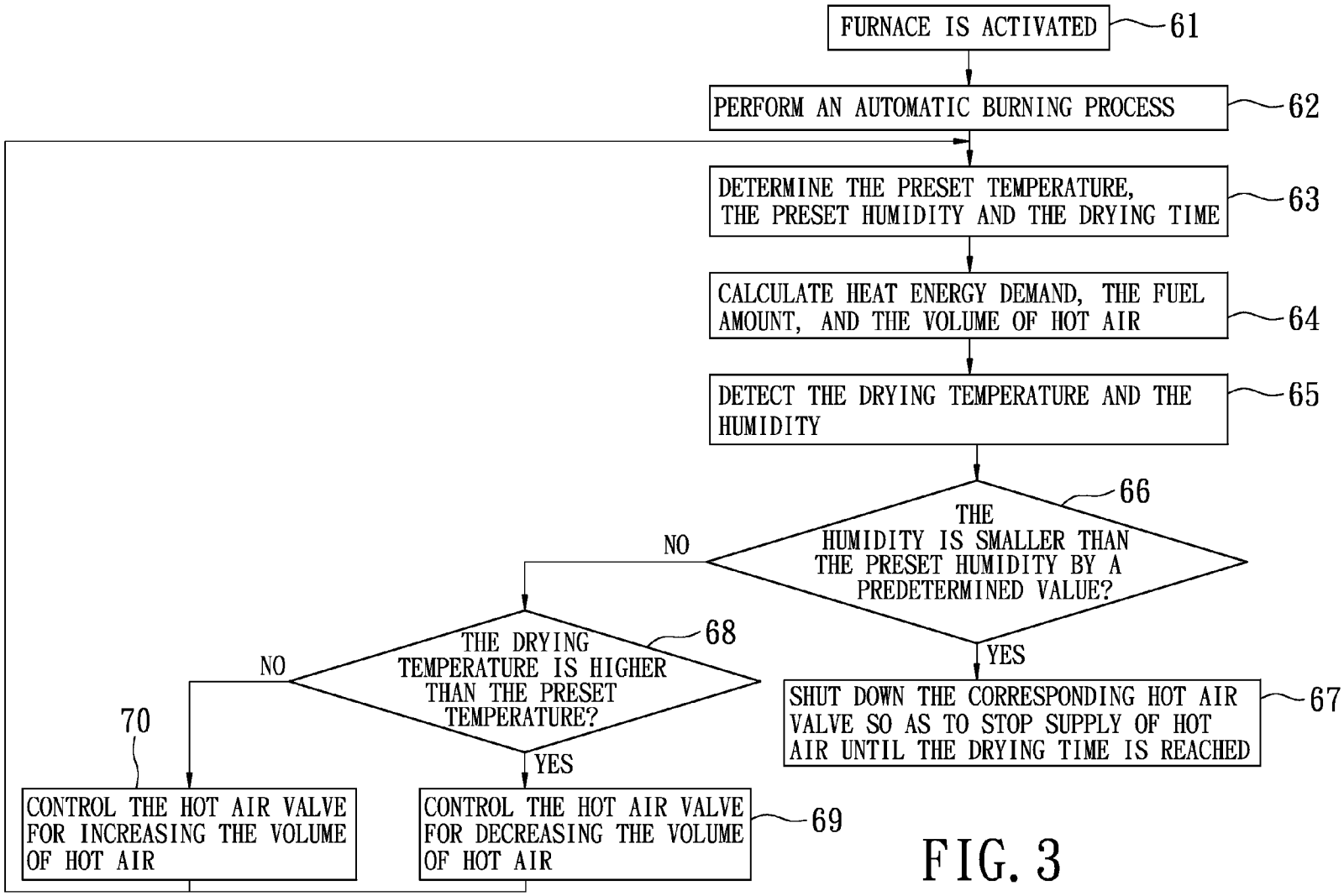
FIG. 3 is a flow chart of the preferred embodiment.

Referring to FIG. 1 to FIG. 3, an operational flow of the preferred embodiment of a method for controlling supply of heat energy from a furnace to multiple dryers, according to the present invention, is disclosed hereinafter:

In step 61, the furnace 11 is activated.

In step 62, the furnace 11 is configured to perform an automatic burning process, and hot air resulting from burning fuel materials is provided from the furnace 11 via the pipe network 13 to each of the dryers 12. At this time, the cool air valve 52 is controlled by the control module 4 to be shut down completely.

In step 63, the calculating module 2 is configured to determine the preset temperature $T_0$, the preset humidity $W_0$ and the drying time t for each of the dryers 12.

In step 64, the control module 2 is configured to calculate heat energy demand of each of the dryers 12 according to the preset temperature $T_0$, the preset humidity $W_0$ and the drying time t of a respective one of the dryers 12, and to calculate the fuel amount to be supplied to the furnace 11 according to the heat energy demand of each of the dryers 12, and the volume of hot air to be supplied to each of the dryers 12 according to the heat energy demand of a respective one of the dryers 12.

In step 65, each of the thermometers 31 is used to detect the drying temperature T in the respective one of the dryers 12, and each of the hygrometers 32 is used to detect the humidity W in the respective one of the dryers 12.

In step 66, for each of the dryers 12, the control module 4 is configured to make a first determination as to whether the humidity W in the dryer 12 is smaller than the preset humidity $W_0$ of the dryer 12 by a predetermined value $\Delta W$.

In step 67, for each of the dryers 12, the control module 4 is configured to shut down the hot air valve 51 so as to stop supply of hot air from the furnace 11 to the respective dryer 12 until the drying time t is reached when a result of the first determination made in step 66 is affirmative.

In step 68, for each of the dryers 12, the control module 4 is configured to make a second determination as to whether the drying temperature T is higher than the preset temperature $T_0$ when the result of the first determination made in step 66 is negative.

In step 69, for each of the dryers 12, when a result of the second determination made in step 68 is affirmative, the control module 4 is configured to control the hot air valve 51 for decreasing the volume of hot air supplied from the furnace 11 to the respective dryer 12, and to adjust the cool air valve 52 for entrance of ambient cool air to the pipe network 13 and for controlling mixing of the cool air with the hot air so as to reduce temperature of the hot air supplied to the respective dryer 12, and the flow goes back to step 63.

In step 70, for each of the dryers 12, when the result of the second determination made in step 68 is negative, the control module 4 is configured to control the hot air valve 51 for increasing the volume of hot air supplied from the furnace 11 to the respective dryer 12, and to control the cool air valve 52 for decreasing or blocking entrance of ambient cool air to the pipe network 13 so as to raise the temperature of the hot air supplied to the respective dryer 12, and the flow goes back to step 63.

It is apparent from the foregoing that the method and the control system for controlling supply of heat energy from a furnace to multiple dryers, according to the present invention, have the following benefits and effects:

This invention is capable of utilizing heat energy generated from the same furnace 11 so as to save fuel materials for burning, and to increase utilization rate of heat energy. This invention may further intelligently satisfy individual drying conditions with respect to the dryers 12 without affecting heat energy supply of the furnace 11, so as to promote economic efficiency thereof.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A method for controlling supply of heat energy from a furnace to multiple dryers, the method to be implemented by a control system and comprising:

(A) configuring the control system to determine a preset temperature, a preset humidity and a drying time for each of the dryers;

(B) configuring the control system to calculate heat energy demand of each of the dryers according to the preset temperature, the preset humidity and the drying time of a respective one of the dryers, and to calculate a fuel amount to be supplied to the furnace according to the heat energy demand of each of the dryers, and a volume of hot air to be supplied to each of the dryers according to the heat energy demand of a respective one of the dryers;

(C) configuring the control system to detect a drying temperature in each of the dryers; and (D) for each of the dryers, configuring the control system to compare the drying temperature and the preset temperature of the dryer, to increase the volume of hot air supplied from the furnace to the dryer when the drying temperature is lower than the preset temperature, and to decrease the volume of hot air supplied from the furnace to the dryer when the drying temperature is higher than the preset temperature.

2. The method as claimed in claim 1, wherein, in step (C), the control system is further configured to detect a humidity in each of the dryers, the method further comprising:

(E) for each of the dryers, configuring the control system to stop supply of hot air from the furnace to the dryer when the humidity in the dryer is smaller than the preset humidity of the dryer by a predetermined value.

3. A control system for controlling supply of heat energy from a furnace to multiple dryers, said control system comprising:

a. calculating module for calculating heat energy demand of each of the dryers according to a preset temperature, a preset humidity and a drying time of a respective one of the dryers, and for calculating a fuel amount to be supplied to the furnace according to the heat energy demand of each of the dryers, and a volume of hot air to be supplied to each of the dryers according to the heat energy demand of a respective one of the dryers;

a detecting module for detecting a drying temperature in each of the dryers; and a control module associated operably with said calculating module and said detecting module;

wherein, for each of the dryers, said control module is configured to compare the drying temperature and the preset temperature of the dryer, to increase the volume of hot air supplied, from the furnace to the dryer when the drying temperature is lower than the preset temperature, and to decrease the volume of hot air supplied, from the furnace to the dryer when the drying temperature is higher than the preset temperature.

4. The control system as claimed in claim 3, wherein said detecting module further detects a humidity in each of the dryers, and wherein, for each of the dryers, said control module is configured to stop supply of hot air from the furnace to the dryer when the humidity in the dryer is smaller than the preset humidity of the dryer by a predetermined value.

5. The control system as claimed in claim 3, further comprising a plurality of valve units each to be disposed between the furnace and a respective one of the dryers, each of said valve units being controlled by said control module for adjusting the volume of hot air supplied from the furnace to the respective one of the dryers.

6. A control system for controlling supply of heat energy from a furnace to multiple dryers, said control system comprising:

a calculating module for calculating heat energy demand of each of the dryers according to a preset temperature, a preset humidity and a drying time of a respective one of the dryers, and for calculating a fuel amount to be supplied to the furnace according to the beat energy demand of each of the dryers, and a volume of hot air to be supplied to each of the dryers according to the heat energy demand of a respective one of the dryers;

a detecting module for detecting a drying temperature in each of the dryers;

a control module associated operably with said calculating module and said detecting module; and a plurality of valve units each to be disposed between the furnace and a respective one of the dryers;

wherein, for each of the dryers, said control module is configured to compare the drying temperature and the preset temperature of the dryer, to increase the volume of hot air supplied from the furnace to the dryer when the drying temperature is lower than the preset temperature, and to decrease the volume of hot air supplied from the furnace to the dryer when the drying temperature is higher than the preset temperature, each of said valve units being controlled by said control module for adjusting the volume of hot air supplied from the furnace to the respective one of the dryers; and wherein each of said valve units includes a hot air valve operable to adjust the volume of hot air supplied from the furnace to the respective one of the dryers, and a cool air valve operable to control mixing of cool air with hot air.

* * * * *